United States Patent [19]

Yamauchi

[11] Patent Number: 4,656,958

[45] Date of Patent: Apr. 14, 1987

[54] TEMPERATURE COMPENSATED SOLENOID IN A SEWING MACHINE

[75] Inventor: Satomi Yamauchi, Aichi, Japan

[73] Assignee: Mitsubishi Denki Kabushiki Kaisha, Tokyo, Japan

[21] Appl. No.: 898,163

[22] Filed: Aug. 18, 1986

[30] Foreign Application Priority Data

Aug. 20, 1985 [JP] Japan ..... 60-182695

[51] Int. Cl.[4] ..... D05B 69/18; D05B 69/20

[52] U.S. Cl. ..... 112/317; 112/121.11

[58] Field of Search ..... 112/317, 316, 121.11, 112/275, 277, 262.1, 220

[56] References Cited

U.S. PATENT DOCUMENTS 4,067,276 1/1978 Mohilo et al. ..... 112/220

4,509,445 4/1985 Fujikawa et al. ..... 112/317

*Primary Examiner*—Peter Nerbun

*Attorney, Agent, or Firm*—Sughrue, Mion, Zinn, Macpeak and Seas

[57] ABSTRACT

A sewing machine control device in which a solenoid is used to reverse sewing directions after a selected number of stitches. The temperature of the solenoid is measured and the energization or deenergization of the solenoid is advanced to account for the thermally increased time constant of the solenoid.

3 Claims, 5 Drawing Figures

TEMPERATURE COMPENSATED SOLENOID IN A SEWING MACHINE

BACKGROUND OF THE INVENTION

1. Field of the Invention

This invention relates to a control device for a sewing machine having an automatic reverse stitching mechanism.

2. Background Art

A sewing machine having an automatic reverse stitching mechanism has been disclosed in the art, for instance by Japanese Patent Application "OPI" No. 80291/1984. In the conventional sewing machine, after a forward stitching operation has been performed over a predetermined number of sewing stitches, a reverse stitching solenoid is energized to perform a backward stitching operation. After the backward stitching has been performed over a predetermined number of sewing stitches, the reverse stitching solenoid is deenergized.

When the reverse stitching solenoid of the conventional sewing machine is energized, its temperature is changed by the current flowing in it, and therefore the electrical resistance of the solenoid is also changed with the result that its time constant is changed. Therefore, the operation timing of the reverse stitching solenoid is changed. Accordingly the resultant number of sewing stitches and seams does not coincide with those predetermined.

SUMMARY OF THE INVENTION

Accordingly, an object of this invention is to eliminate the above-described difficulties of a conventional sewing machine with a reverse stitching function. More specifically, an object of the invention is to provide a sewing machine control device with which, even when the temperature of the reverse stitching solenoid changes, the resultant number of sewing stitches and seams coincide with those which have been determined in advance.

In a sewing machine control device according to the invention, the temperature of the reverse stitching solenoid is detected to determine the operating time constant of the reverse stitching solenoid, and the time constant thus determined is utilized to control the timing of exciting the reverse stitching solenoid.

The time of action of the reverse stitching solenoid is controlled constant irrespective of the temperature of the reverse stitching solenoid.

Figure 1:
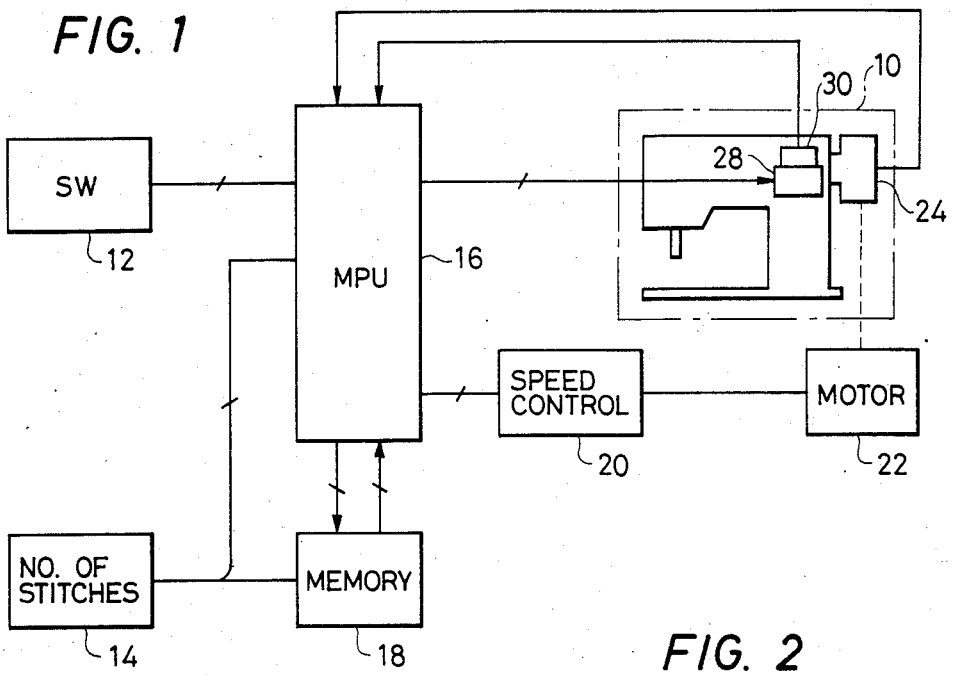
FIG. 1 is a block diagram of the structure and circuitry of the sewing machine of the invention.
Figure 2:
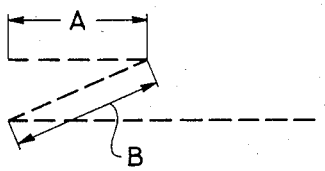
FIG. 2 is an example of a stitching pattern.

FIGS. *3a–3c* are timing diagrams for the apparatus of FIG. 1 to accomplish the stitching pattern of FIG. 2.

DETAILED DESCRIPTION OF THE PREFERRED EMBODIMENTS

FIG. 1 is a block diagram showing one embodiment of this invention. In FIG. 1 is shown a sewing machine 10. A switch such as a foot switch controls the operation of the sewing machine. A setting means 14 is set for the number of stitches. A microprocessor controls the drive of the sewing machine 10 according to instruction signals from the switch 12. A memory means 18 stores various data necessary for a sewing operation. A speed control means 20 controls the speed. A motor 22 has control means such as a clutch and a brake for the sewing machine 10. A detector 24 is mounted on the arm shaft (not shown) of the sewing machine 10, to detect the upper and lower positions of the needle and the speed of needle. A reverse stitching solenoid 28 is provided inside the sewing machine 10. A temperature detecting means 30 detects the temperature of the solenoid 28. The microprocessor 16 serves also as a control section for controlling the on-off timing of the current applied to the reverse stitching solenoid 28.

The operation of the sewing machine control device thus organized is as follows. First, the switch 12 is operated to supply an instruction signal to the microprocessor. In response to the instruction signal, the microprocessor 16 reads data out of the number-of-stitches setting means 14 and stores it in the memory means 18, and drives, according to the data thus stored, the motor 22 at a preset constant speed through the speed control circuit 20. As a result, the arm shaft (not shown) of the sewing machine 10 is rotated. Because of the rotation of the arm shaft, the upper position of the needle is detected by the detector 24 and the number of occurrences of the upper position is counted by the microprocessor 16 so as to control the reverse stitching solenoid 28 inside the sewing machine 10.

The control is carried out as shown in FIG. 2. In FIG. 2 for convenience in description, overlapped stitches are shown shifted. When a forward stitching operation is carried out as indicated at A in FIG. 2, the detector 24 outputs a needle upper position signal as shown in part (a) of FIG. 3. The signal is counted by the microprocessor 16.

It is assumed that the microprocessor 16 is so set that when the forward stitching operation is performed for five stitches, the backward stitching operation is started. In this case, at the time instant $t_1$ in FIG. 3, current is supplied to the reverse stitching solenoid 28. As a result, at the time instant $t_2$ which is later by as much as an electro-mechanical delay time $\tau_1$ than the time instant $t_1$, the reverse stitching solenoid 28 is operated as shown in part (b) of FIG. 3, and the backward stitching operation is carried out as indicated at B in FIG. 2. However, as was described before, when current is applied to the reverse stitching solenoid 28, its electrical resistance is increased because of the current and the time constant is therefore increased. Accordingly, the time instant at which the reverse stitching solenoid 28 is actually operated is not the predetermined time instant $t_2$ but may occur at a time instant which is later than the time instant $t_2$.

In order to operate the reverse stitching solenoid 28 at the time instant $t_2$, the sewing machine control device of the invention is so designed that the supply of current to the reverse stitching solenoid 28 is started at the time instant which is earlier by a period of time $\tau_3$ than the time instant $t_1$ of the last pulse signal. This timing is determined as follows. The current I flowing in the reverse stitching solenoid 28 can be represented by the following equation (1):

$$I = \frac{E}{R}(1 - e^{-Rt/L}) \quad (1)$$

where E is the exciting voltage of the reverse stitching solenoid 28, L is the inductance of the reverse stitching solenoid 28, and e is the base of the natural logarithm.

It is assumed that the reverse stitching solenoid 28 operates when $I=I_0$. In this case, the time $\tau_1$ which elapses until the current reaches that value can be represented by the following equation (2):

$$\tau_1 = \frac{L}{R} \ln \frac{E}{E - RI_0} \quad (2)$$

The resistance R of the reverse stitching solenoid 28 at a temperature T can be represented by the following equation (3):

$$R = R_0(1 + \alpha(T - T_0)) \quad (3)$$

where $R_0$ is the resistance of the reverse stitching solenoid 28 at a reference temperature $T_0$, and $\alpha$ is the temperature coefficient of the resistance.

If the temperature T is detected by the temperature detecting device 30, then the resistance R of the reverse stitching solenoid 28 can be obtained from equation (3). As the resistance R of the reverse stitching solenoid 28 is $R_0$ at the reference temperature $T_0$, the equation (2) can be rewritten as follows:

$$\tau_1 = \frac{L}{R_0} \ln \frac{E}{E - R_0 I} . \quad (4)$$

It is assumed that, when current is supplied to the reverse stitching solenoid 28, its temperature is raised to $T_1$ and its resistance to $R_1$. In this case, the time constant is longer by $\tau_3$ than $\tau_1$, and can be therefore represented by the following equation (5):

$$\tau_1 + \tau_3 = \frac{L}{R_1} \ln \frac{E}{E - R_1 I_0} . \quad (5)$$

Therefore, equation (3) can be represented by the following equation:

$$\tau_3 = \frac{L}{R_1} \ln \frac{E}{E - R_1 I_0} - \frac{L}{R_0} \ln \frac{E}{E - R_0 I_0} \quad (6)$$

Figure 3:
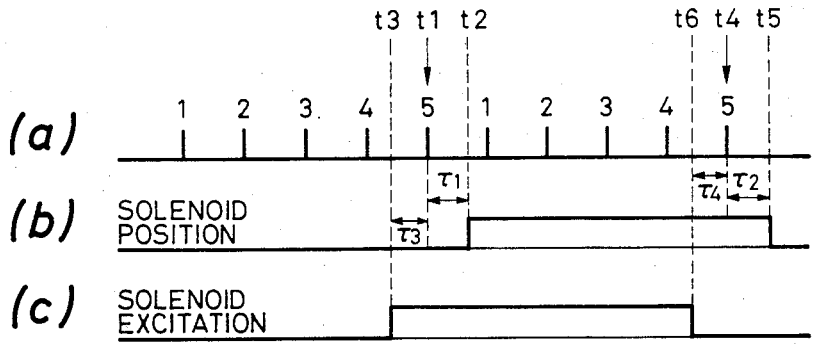

Therefore, the temperature induced delay $\tau_3$ is calculated by the microprocessor 16 according to equation (6) and the exciting timing of the reverse stitching solenoid 28 is set to the time instant $t_3$ earlier by $\tau_3$, as shown in part (c) of FIG. 3. Then the reverse stitching solenoid 28 starts its operation at the time instant $t_2$ in part (b) of FIG. 3, as predetermined.

As the reverse stitching solenoid 28 is operated, the backward stitching operation is carried out as indicated at B in FIG. 2. If the reverse stitching solenoid 28 is deenergized at the time instant $t_4$ when the backward stitching operation has been performed for five stitches, the reverse stitching solenoid 28 is fully restored at the time instant $t_5$ which is later by a period $\tau_2$ than the time instant $t_4$ of the last pulse signal, as shown in part (b) of FIG. 3. However, similarly as in the start time, the time constant is made larger by the current flowing in the solenoid, and therefore it is necessary to deenergize the reverse stitching solenoid at a time instant $t_6$ which is earlier by a thermally induced delay $\tau_4$ than the time instant $t_4$.

This timing can be obtained as follows. If the current in the reverse switching solenoid before switching is E/R, then the current at a time $t=\tau_2$ after switching off the voltage source is $I=I_0$ where $t=\tau_2$:

$$I_0 = \frac{E}{R} e^{-R\tau_2/L} \quad (7)$$

Therefore, the value $\tau_2$ is:

$$\tau_2 = \frac{L}{R} \ln \frac{E}{RI_0} \quad (8)$$

If $R=R_0$ when $T=T_0$, then the value $\tau_2$ is:

$$\tau_2 = \frac{L}{R_0} \ln \frac{E}{R_0 I_0} \quad (9)$$

If $R=R_2$ when $T=T_2$, then $$\tau_2 + \tau_4 = \frac{L}{R_2} \ln \frac{E}{R_2 I_0} \quad (10)$$

Therefore, the value $\tau_4$ can be represented by the following equation:

$$\tau_4 = \frac{L}{R_2} \ln \frac{E}{R_2 I_0} - \frac{L}{R_0} \ln \frac{E}{R_0 I_0} \quad (11)$$

Therefore, if the reverse stitching solenoid 28 is deenergized at the time instant $t_6$ as indicated in part (c) of FIG. 3, then as shown in part (b) of FIG. 3 the reverse stitching solenoid 28 is restored at the time instant $t_5$ as planned. And when the reverse stitching solenoid 28 is restored as described above, the forward stitching operation is carried out again.

The number of stitches set by the number-of-stitches setting means 14 is temporarily stored in the memory means 18. For instance in the case where "five stitches" is set as was described before, immediately after the stitching operation starts, the number of stitches "5" is stored in the memory means. When the cloth is sewn two stitches the number of stitches "3" is stored. In the manner, the stitching operation is continued until the number of stitches set in the memory means is zeroed.

In order to allow the microprocessor to operate the above-described equations (1) through (11), the memory means 18 stores the following data:

a. In the case when the reverse stitching solenoid is in the "on" state,

E: The supply voltage $I_0$: The operating current of the solenoid $R_0$: The resistance of the solenoid at a temperature $t_0$ L: The inductance of the solenoid b. In the case when the reverse stitching solenoid 28 is in "off" state, the above-described values of E, $I_0$, $R_0$ and L are stored for equation (11).

In the case of the equation (6) or (11), it is necessary to calculate the natural logarithm of a number of values. A data table of the logarithms of these values may be stored in the memory means in advance.

Examples of the temperature detecting means 30 are a thermister (which may be either of positive characteristic or of negative characteristic), a thermocouple (made of copper and "Constantan" for instance), an infrared detecting element (which performs measurement through the quantity of infrared radiated energy) and a semiconductor detecting element. These examples are conventional ones, and their detailed descriptions will not be made.

In detecting a temperature with a semiconductor detecting element, since its voltage or resistance is, in general, non-linear with respect to temperature, it is preferable to additionally employ means for correcting the non-linearity due to temperature, such as means for correcting it with a voltage and temperature table. Then, the percentage variation in the signal equals the percentage variation in the temperature.

I claim:

1. A sewing machine control device comprising:

a reverse stitching solenoid for providing power to reverse a sewing direction;

temperature detecting means for detecting a temperature of said reverse stitching solenoid; and a control section to which a temperature detection signal is applied by said temperature detecting means, wherein said control section adjusts a timing of turning on or off of current supplied to said reverse stitching solenoid according to said temperature thus detected.

2. A sewing machine control device as claimed in claim 1, in which said control section comprises:

memory means for temporarily storing a selected number of sewing stitches;

means for providing a signal indicating a sewing needle position; and a microprocessor to which said signal indicating a sewing needle position is applied and which counts said signal and compares said signal with the number of sewing stitches stored in said memory means, said microprocessor setting said timing so that said turning on or off of current supplied to said reverse stitching solenoid is effected before a time instant when the number of sewing stitches stored in said memory means coincides with the number of sewing stitches determined by counting said signal indicating a sewing needle position, and causing said reverse stitching solenoid to start or end an operation thereof after the time instant when the number of sewing stitches coincide with each other.

3. A sewing machine control device as recited in claim 1, wherein said control section calculates a time for said timing dependent upon a logarithm of said detected temperature.

* * * * *